United States Patent [19]

Rosen

[11] Patent Number: 4,608,496

[45] Date of Patent: Aug. 26, 1986

[54] STRAND BREAK DETECTOR

[75] Inventor: Johnny Rosen, Höllviksnäs, Sweden

[73] Assignee: Trelleborg AB, Trelleborg, Sweden

[21] Appl. No.: 558,185

[22] Filed: Dec. 5, 1983

[30] Foreign Application Priority Data

Dec. 3, 1982 [SE] Sweden ..... 8206907

[51] Int. Cl.[4] ..... G01N 21/89; G01N 21/86

[52] U.S. Cl. ..... 250/561; 57/61

[58] Field of Search ..... 57/81, 19, 61; 200/61.18; 250/571, 561, 559; 340/677; 28/187; 66/161; 139/273 A; 242/37 R

[56] References Cited

U.S. PATENT DOCUMENTS

| | | | |
|---|---|---|---|
| 3,345,812 | 10/1967 | Pickering | 250/561 |
| 3,621,267 | 11/1971 | Dent | 250/561 |
| 4,194,840 | 3/1980 | Lucas et al. | 250/571 |
| 4,213,056 | 7/1980 | Matsumura et al. | 250/559 |
| 4,341,958 | 7/1982 | Ohsawa | 250/561 |
| 4,471,816 | 9/1984 | Wada | 250/561 |

*Primary Examiner*—David C. Nelms
*Assistant Examiner*—Michael Messinger
*Attorney, Agent, or Firm*—Merchant, Gould, Smith, Edell, Welter & Schmidt

[57] ABSTRACT

Strand break detector for monitoring a number of straightened strands extending along a number of predetermined paths, with regard to a broken or missing strand. An optical transmitter with light-receiving means is arranged to supply, at relative motion between strands and transmitter transversely of the strands, a signal for each passing strand. A shield is arranged as a spacer in front of the light-receiving means and forms an inlet for light to the light-receiving means, and a slide surface for guiding the strands engaging the slide surface, past the light inlet at relative movement between the strands and the transmitter.

8 Claims, 9 Drawing Figures

STRAND BREAK DETECTOR

Figure 1:
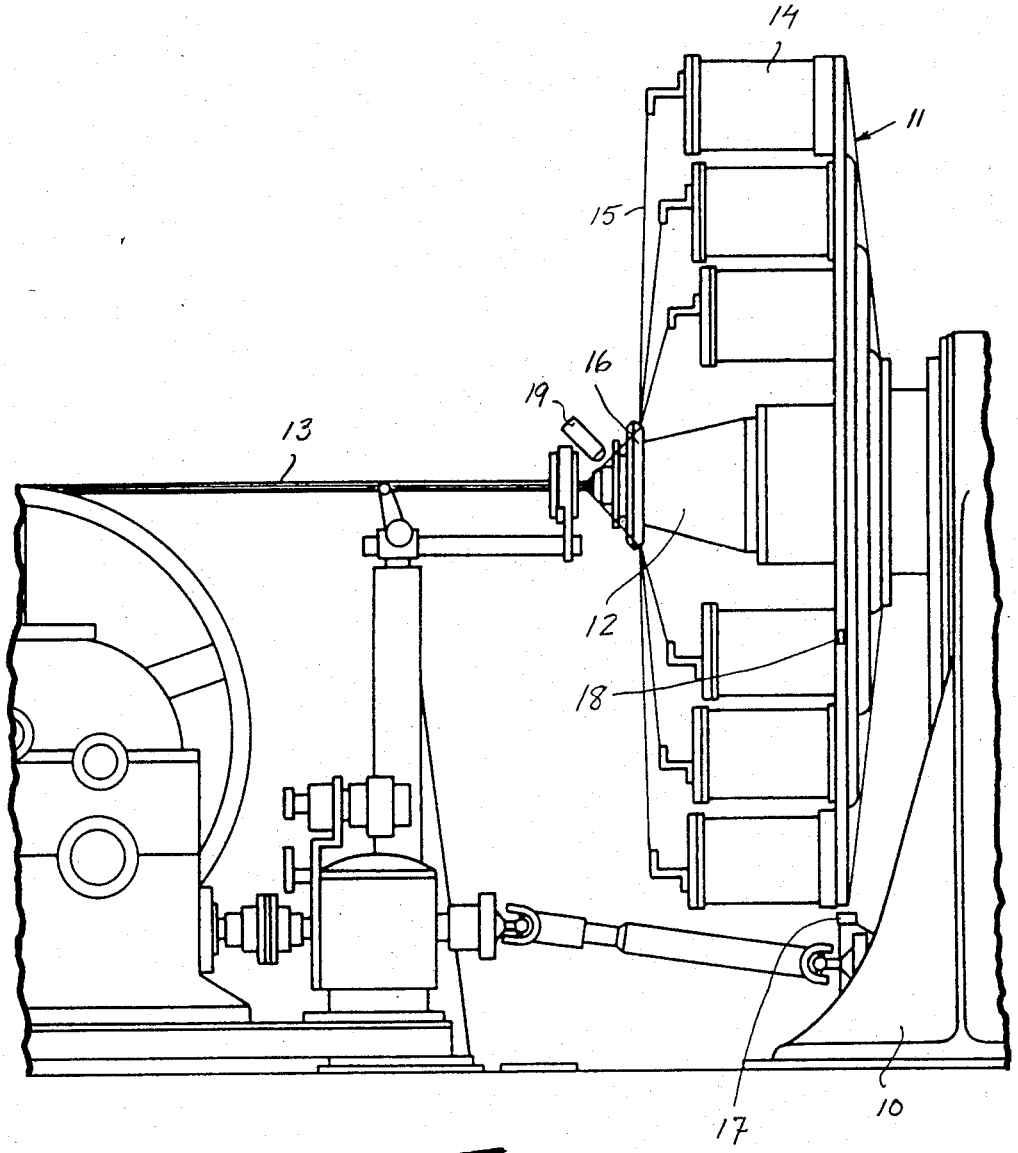

The present invention relates to a strand break detector for monitoring a number of straightened strands extending along a number of predetermined paths, with regard to a broken or missing strand, comprising an optical transmitter with light-percepting means, arranged to supply, at relative motion between strands and transmitter transversely of the strands, a signal for each passing strand, and an electronic circuit for receiving and processing the signal from the transmitter.

The invention has come up particularly in connection with the manufacture of such products which are provided with a spun or braided strand reinforcement, e.g. strand-reinforced hoses and cables, but as to the generic scope thereof the invention can be applied also to monitoring breakage of strand in connection with the manufacture of other products where a plurality of strands are being advanced, e.g. in textile machines.

In a manufacturing process wherein a plurality of strands are being advanced, to which there is often imparted e.g. when hoses and cables are reinforced by strands, in addition to the movement in the longitudinal direction of the strands also a movement in the transverse direction thereof, as is required in order to spin or braid the strands around the hose or cable, expensive product scrapping, time-loss or material waste are caused by a strand breakage or if a strand is missing for other reasons. The problem involved in strand breakage is well known in the art, and a number of solutions have been proposed in order to solve this problem in a satisfactory manner. One solution comprises a strand break detector of the type referred to above and is disclosed in U.S. Pat. No. 3,345,812. This strand break detector includes an advanced electronic circuit, and in the patent literature there are also other examples showing that the great possibilities offered by the electronics today are utilized in strand break detectors in order to provide electronic systems with a rapid and reliable response for processing and utilizing signals from transmitters of different types. However, the prior art systems apparently do not overcome in a satisfactory manner the difficulties which can arise at the transmitter proper due to strand vibrations which may result in the detection of the presence of a strand not being sufficiently distinct due to the fact that the transmitter has been covered by dust on other particles from the strands and from the surroundings and also due to influence of light from the surroundings, which falls upon the transmitter.

Due to these difficulties the strand detection can be jeopardized and accordingly the transmitter signal will not be reliable, which in turn may result in a non-satisfactory function of the strand break detector no matter how advanced electronic system is used therein.

The object of the present invention is to overcome the difficulties mentioned above, and in accordance herewith the invention provides a strand break detector for monitoring a number of straightened strands extending along a number of predetermined paths, with regard to a broken or missing strand, comprising an optical transmitter with light-percepting means, arranged to supply, at relative motion between strands and transmitter transversely of the strands, a signal for each passing strand, an electronic circuit for receiving and processing the signal from the transmitter, a shield arranged in front of the light-percepting means and forming an inlet for light to the light-percepting means, and a slide surface on said shield for guiding the strands engaging the slide surface, past the light inlet at relative movement between the strands and the transmitter transversely of the strands, the shield being arranged as a spacer between the light-percepting means and the strands.

By the invention it is achieved that the strand is always kept at a predetermined distance from the light-percepting means of the transmitter when the strand passes the transmitter either by the strand passing the transmitter transversely of the strand or the transmitter passing the strand transversely thereof. Due to the fact that the strand is supported by the shield at the relative movement between the strand and the transmitter the light-percepting means can be passed without occurring vibration of the strand, said means at the same time being satisfactorily protected against dust deposition. The shield also prevents ambient light from adversely affecting the signal transmission from the transmitter and also protects against damage of the light-percepting means which in most cases comprises a lens. Finally, there is achieved by the invention that the adjustment of the transmitter in relation to the strands (focusing) is substantially facilitated.

Figure 2:
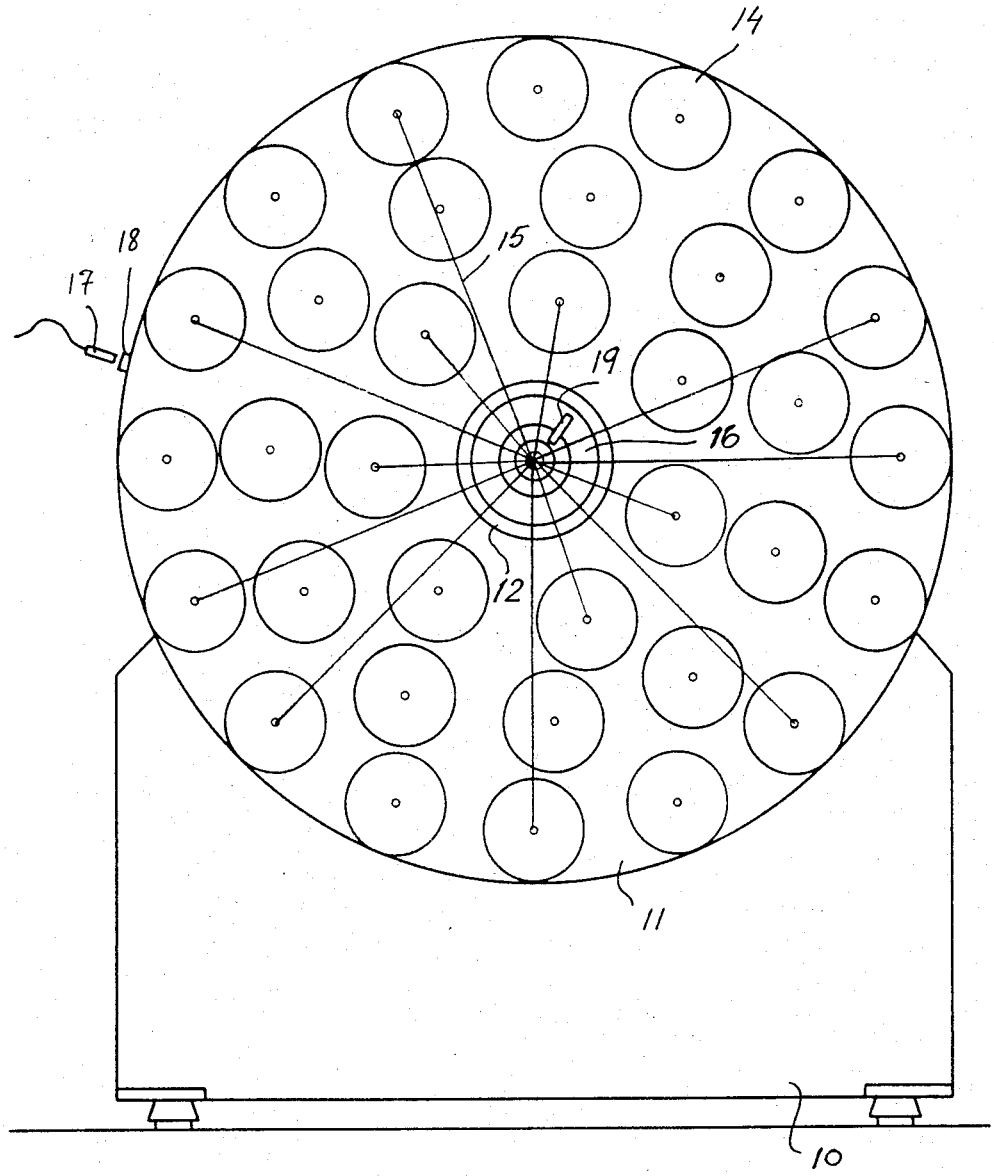
Figure 3:
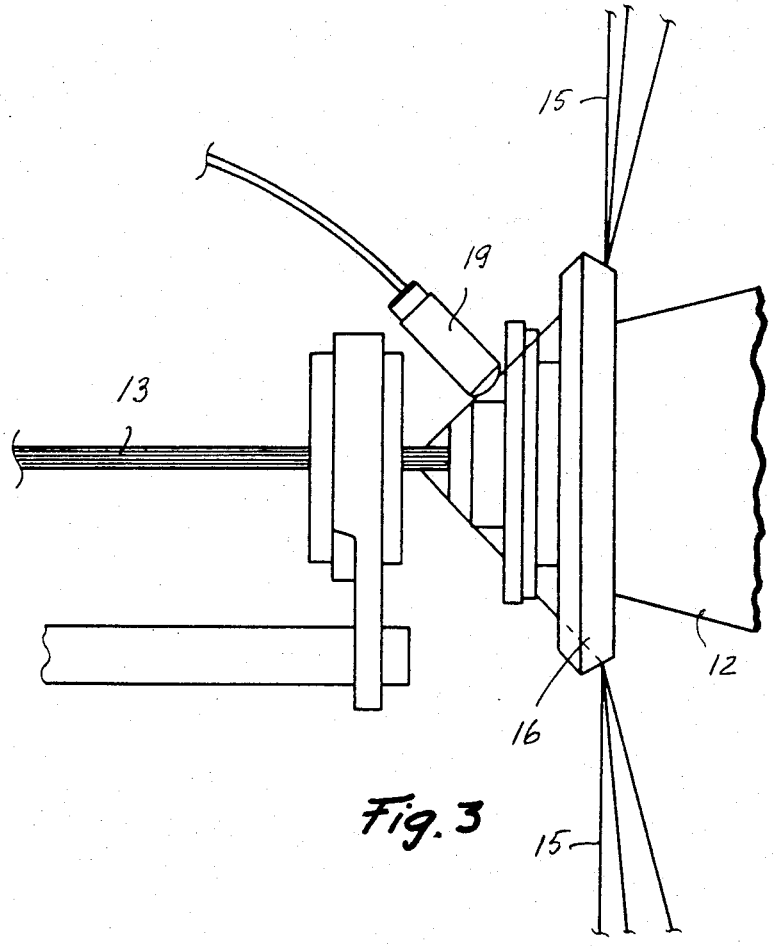
Figure 4:
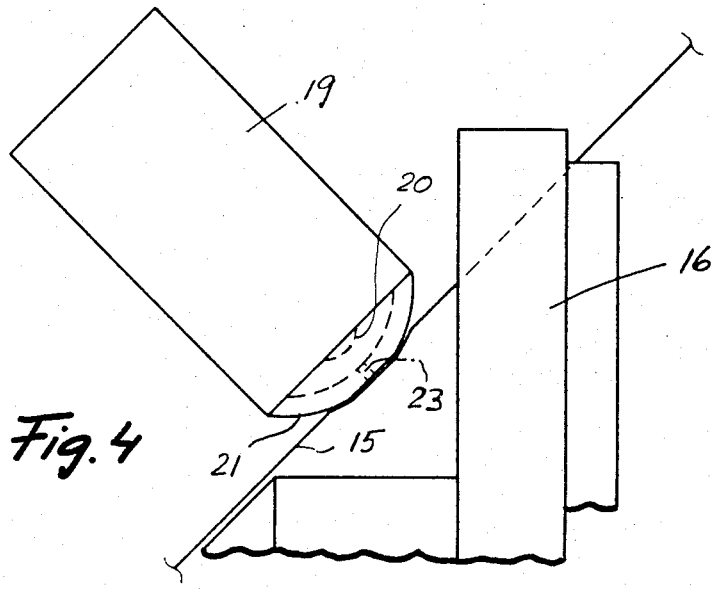
Figure 5:
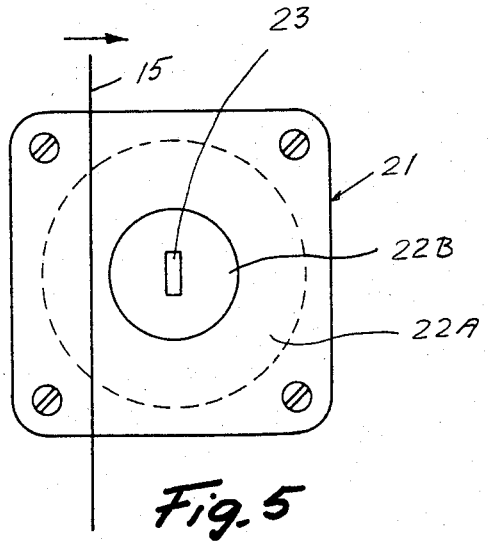
Figure 6:
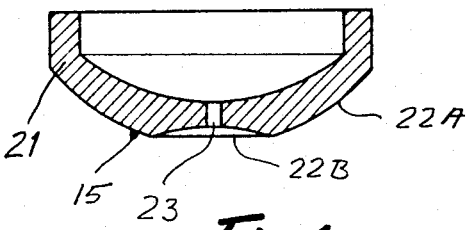
Figure 7:
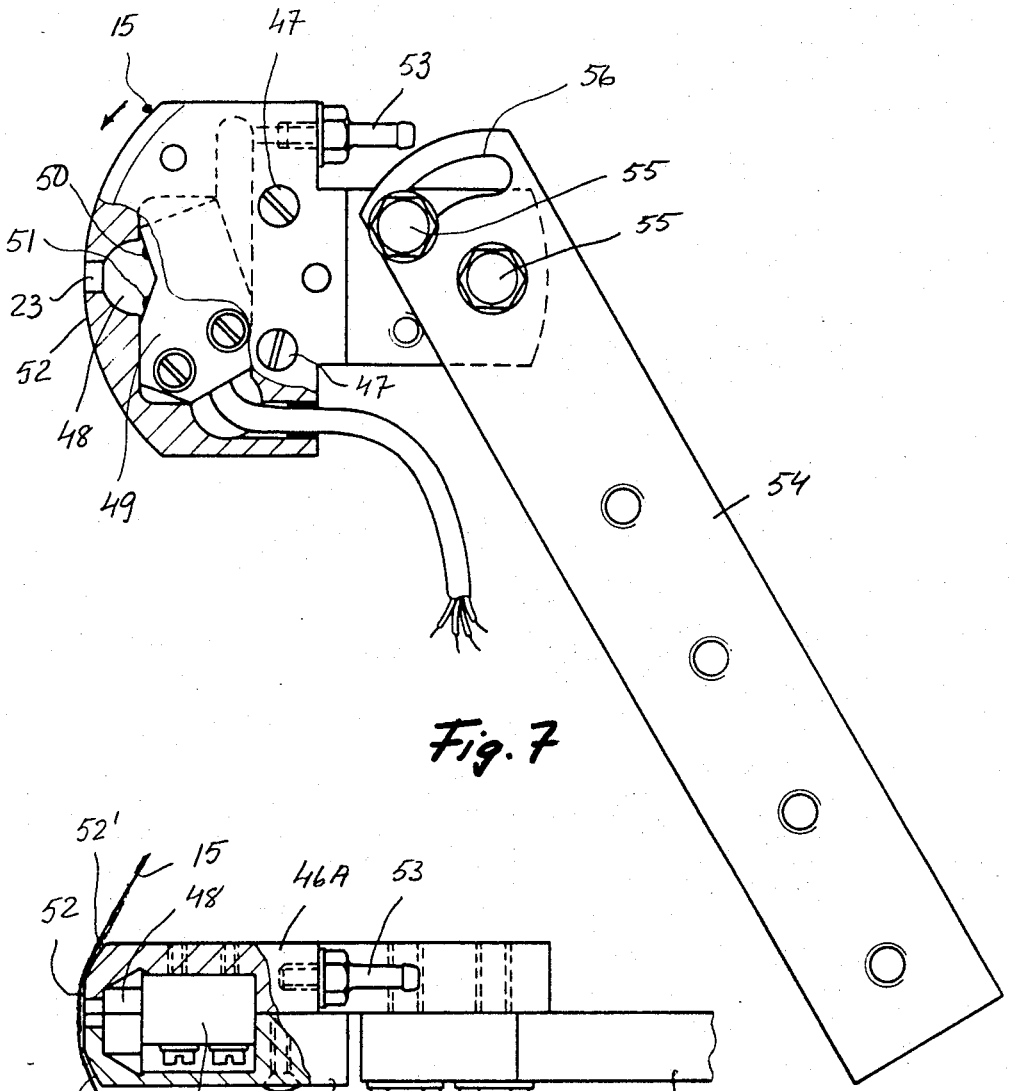
Figure 8:
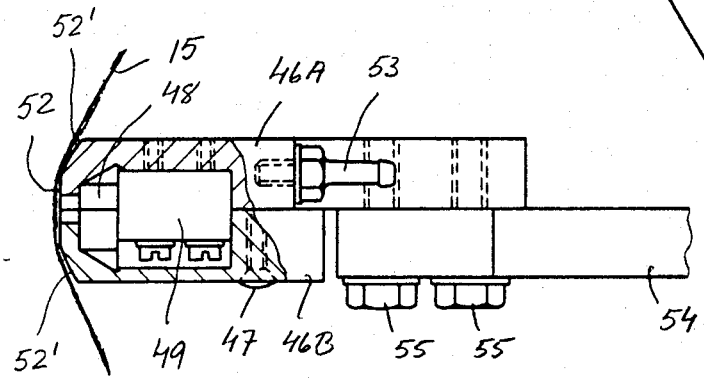
Figure 9:
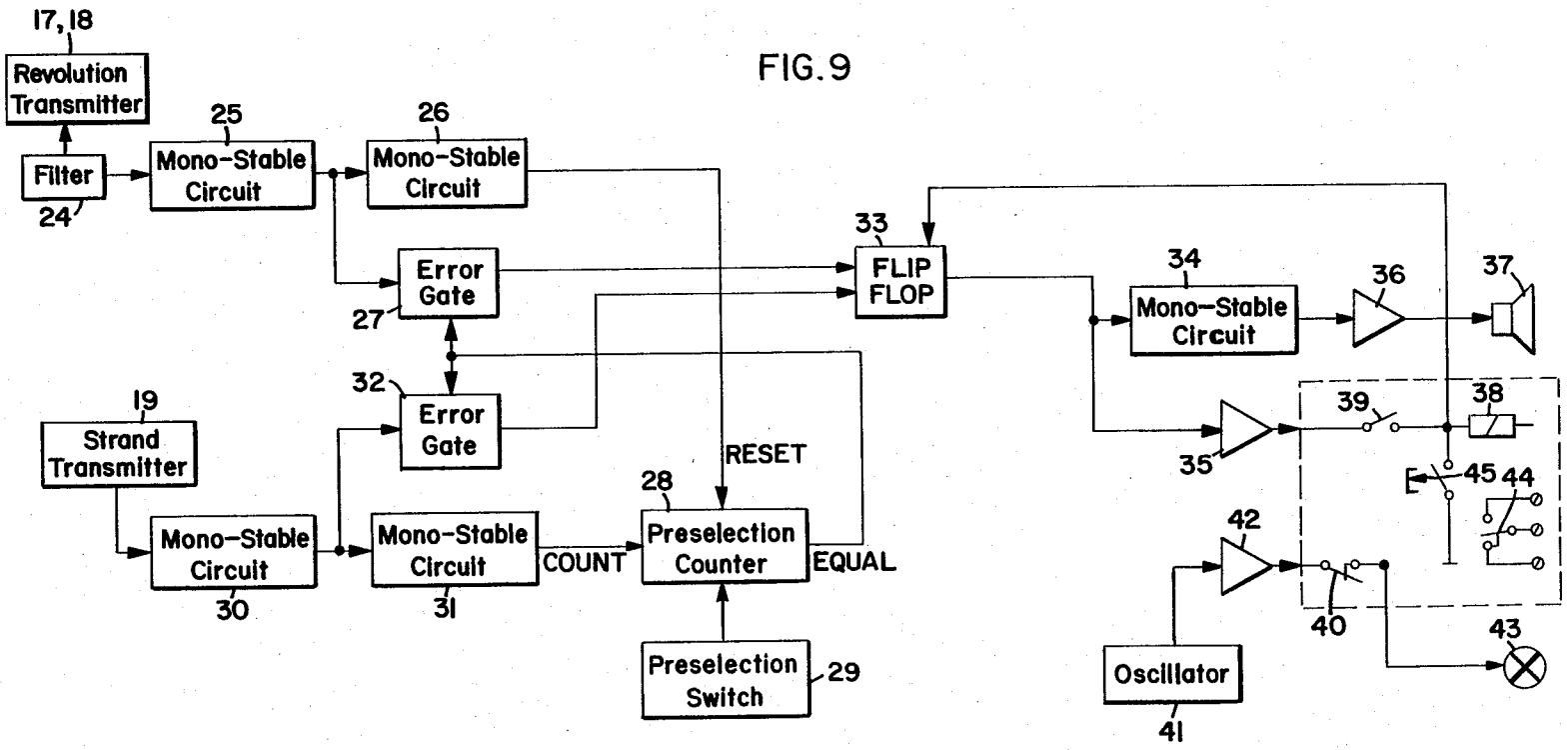

In order to explain in detail the invention an embodiment thereof will be described below, reference being made to the accompanying drawings in which FIG. 1 fragmentarily discloses a side view of a machine for manufacturing strand-reinforced hose, FIG. 2 is a front view of a spool wheel forming part of the machine, FIG. 3 is an enlarged fragmentary side view of that part of the machine where the strands are applied to the hose and where the transmitter of the strand break detector of the invention is located, FIG. 4 is a further enlarged side view of the transmitter and a passing strand, FIG. 5 is a front view of the shield of the transmitter, FIG. 6 is a cross-sectional view of the shield, FIG. 7 is a side view, partly a cross-sectional view, of another embodiment of the transmitter, FIG. 8 is a fragmentary plan view, partly a cross-sectional view, of the transmitter in FIG. 7, and FIG. 9 is a block diagram showing the electronic system connected to the transmitter.

The machine fragmentarily shown in FIGS. 1 and 2 and partly also in FIGS. 3 and 4 is of a known construction and therefore will be described only broadly. The machine comprises a frame 10 wherein there is rotatably mounted a spool wheel 11 the central hub 12 of which is tubular for passing therethrough the hose 13 to be provided in the machine with a spun or braided strand reinforcement. The spool wheel supports a plurality of strand spools 14 from which strands 15 are extended to a strand guide 16 on the hub 12 to be forwarded to the hose 13. A further spool wheel usually is arranged on the frame 10 reversed in relation to the spool wheel shown herein, in order that the hose passing through the tubular central hubs of the two spool wheels will be provided with a double layer strand reinforcement, the two reinforcements being wrapped in opposite directions by the two spool wheels being rotated in opposite directions. For each of the spool wheels there can be provided a strand break detector according to the invention and therefore the description of the strand break detector, which follows and relates to the spool wheel shown, in all respects is true also for the other spool wheel.

In the machine, there is provided an induction sensor for supplying a signal for each revolution of the spool wheel 11. This induction sensor comprises an element 17 stationarily mounted to the frame 10, and an element 18 mounted to the periphery of the spool wheel and thus rotating together with said wheel, the stationary element 17 being located adjacent the rotational path of the element 18 such that there is supplied from the element 17 an impulse each time the element 18 passes the element 17.

In the area where the strands 15 are passed from the guide 16 onto the hose 13 there is provided an optical transmitter 19 which can comprise a photo-cell of the mark detector type with a light source and a light-percepting element in one and the same unit. The light-percepting means may alternatively be labeled a light-receiving means. Such optical detectors of many different makes are available on the market and therefore it is not necessary to explain in detail here the construction of such a transmitter. The transmitter has a lens 20 which according to the invention is covered by a shield 21. This shield is shown in more detail in FIGS. 5 and 6 and in one embodiment thereof can comprise a metal shield polished on the outside thereof, which has on the inside thereof a dull-black coating. On the outside, the shield has a smooth annular spherically curved surface 22A which surrounds a central concave depression 22B. Opposite to the centre of the lens 20 the shield forms a rectangular aperture 23 which is elongated transversely of the mounting direction of the strands. Due to the fact that the aperture is located in the concave depression 22B the strand is prevented from being caught by the edges of the aperture which could lead to breaking of the strand.

In FIG. 5, a strand 15 is shown and the movement thereof past the shield is indicated by an arrow. The transmitter 19 is located in relation to the strands passing at the rotation of the spool wheel 11, such that the strands slide against the smooth outside surface of the shield past the aperture 23. The portion of the strand located just in front of the aperture 23 will be illuminated by the light source of the optical transmitter 19 and the light reflected from the strand will be sensed by the light-sensitive means of the transmitter (photo-cell) for the supply of an impulse from the transmitter, which indicates that a strand has passed. Since the strand slides against the shield 21 it will always be located at a predetermined distance from the lens 20, preferably in the focal area thereof, when passing the transmitter, and it will also be prevented from vibrating, because it is supported by the shield, which all makes the sensing of the passage of the strand past the transmitter 19 particularly reliable. Moreover, the lens 20 is protected against incident ambient light as well as dust deposition by means of the shield arranged over the lens.

Before the system for processing the signals obtained from the transmitter 17, 18 and from the transmitter 19 when the machine is operated is described in more detail, some modifications which can be applied to the shield, will be mentioned herein. E.g. the shield 21 of metal described herein can be provided with a small radial passage from the outside of the shield to the interior space bound by the shield and the lens, the aperture 23 communicating with said space. By supplying air under some positive pressure through said passage, the air being allowed to escape through the aperture 23, further guarantee is obtained for preventing dust and other particles from accumulating on the surface of the lens, because there is all the time provided an air circulation through the space between the shield and the lens. Thus, it is impossible for dust to remain in this space.

A transmitter of this type is shown in FIGS. 7 and 8. The shield thereof is constructed as a plastic housing consisting of two parts 46A and 46B and having a smooth outer surface, said parts being interconnected by means of screws 47 and forming a cavity 48. In this cavity, the optic means 49 are arranged with the lens 50 of the light source and the lens 51 of the light-percepting means facing the aperture 23 so as to have the focal range in the opening thereof, which is located in a cylindrical slide surface 52 on the plastic housing, having curved chamfer edge portions 52'. A socket 53 is arranged on the housing for the supply of air under positive pressure to the cavity 48, said air escaping through the aperture 23, The movement of the strands 15 over the housing is indicated in FIG. 7 by means of an arrow.

The transmitter in FIGS. 7 and 8 is adjustably supported by a support arm 54 to which the housing is mounted at a lug formed by one part 46A of the housing, by means of screws 55, one screw passing through a circularly curved slot 56 allowing the housing to be arrested in different angular positions on the support arm 54.

In another modification, the entire shield is made of a transparent material and in this case it is not necessary to provide an aperture 23, because the strand can be illuminated and the reflected light from the strand can be perceived through the transparent material. As will be easily understood, a transparent plastic material in this case is a suitable material for the shield.

Referring to FIG. 9 which discloses the electronic system for processing the signals from the two transmitters, the revolution transmitter is indicated at 17, 18 and the strand transmitter is indicated at 19 just as in FIGS. 2 to 4. Referring first to the transmitter 17, 18, this is an induction type transmitter as mentioned above and supplies a signal pulse for each revolution of the spool wheel 11. However, it is possible to have transmitters of other types for this purpose, e.g. a mechanical circuit breaker or an optical or capacitive transmitter, and depending on the transmitter used the signal pulse from the transmitter will be of different character and will be more or less distinct. E.g. in case of a mechanical circuit breaker the signal in some cases may comprise a pulse train. In order to obtain a distinct square pulse the transmitter 17, 18 is connected to a filter 24 which can comprise an RC net and a Schmitt trigger gate. Following the filter there is arranged a monostable circuit 25 which is a pulse former imparting to the square pulse obtained from the filter a predetermined length. The signal from the monostable circuit 25 is supplied to a further monostable circuit 26 and an error gate 27, the monostable circuit 26 providing a very short signal (spike) for each square pulse received. This signal is transmitted to a pre-selection counter 28 provided with a pre-selection switch 29 which can be adjusted manually to a desired number.

The transmitter 19 is also connected to a monostable circuit 30 of the same type and for the same purpose as that of the monostable circuit 25. Also between this transmitter and the monostable circuit 30 there can be provided a filter similar to the filter 24 although this is not necessary in case of an optical transmitter of the kind referred to herein, and therefore has not been shown. In the same manner as described above, the monostable circuit 30 is connected to a monostable circuit 31 and an error gate 32, the monostable circuit 31 having the same function as the monostable circuit 26, i.e. to provide a short pulse (spike) to the pre-selection counter 28 for each signal pulse from the transmitter 19.

The pre-selection counter 28 is arranged to count after having been zeroed by a signal from the monostable circuit 26, the number of pulses from the monostable circuit 31 and to supply, after the reception of the number of pulses pre-set in the pre-selection switch 29, a signal (equal) to the two error gates 27 and 32. Thus, if the spool wheel 11 has 34 spools as in the embodiment shown and 34 strands are applied to the hose 13, 34 pulses will be supplied from the transmitter 19 for each revolution of the spool wheel. Accordingly, the pre-selection switch 29 then should be adjusted to the number 34 and the pre-selection counter should supply a signal to the error gates 27 and 32 after having received 34 pulses from the transmitter 19. Immediately after this a signal from the transmitter 17, 18 will re-set the pre-selection counter 28 by a signal being supplied to the counter from the monostable circuit 26 such that the pre-selection counter can start a new counting.

The two error gates 27 and 32 are connected to the input of an error flip-flop 33 which comprises a bistable circuit and is connected at the output thereof to a monostable circuit 34 and to an amplifier 35. The monostable circuit controls an amplifier 36 which feeds an acoustic alarm device 37. The amplifier 35 energizes a relay coil 38 over a self-holding contact 39. This relay has a contact 40 controlling the connection to an oscillator 41 via an amplifier 42 to a signal lamp 43, and it has also a contact 44 which can control the spinning or braiding machine as to start and stop.

The error flip-flop has a normal position in which the alarm device 37 is not activated, and another position in which the alarm device 37 is activated via the monostable circuit 34 and the amplifier 36, said circuit being arranged as a timer to disconnect the alarm device 37 at a predetermined time after the activation of the alarm device. In the normal position of the error flip-flop 33 the amplifier 35 provides a current but in order that the relay 38 will be energized a switch 45 to be actuated manually must be closed. Then, the relay 38 will be held energized due to the fact that current is supplied to the relay from the amplifier 35 via the self-holding contact 39. When the switch 45 is closed, the relay contact 44 is adjusted to such position that the machine will start or can be started, and the relay contact 40 is adjusted to such position that the lamp 43 is de-energized. The described condition is the normal operative condition of the strand break detector. As long as pulses from the transmitter 19 are supplied to the pre-selection counter 28 in a predetermined number within the interval defined by the transmitter 17, 18, the system will be in the condition described as long as all strands are spun or braided on the hose in the intended manner.

If a number of pulses which is too small should be counted in the interval defined by the transmitter 17, 18, a comparison of the signal from the pre-selection counter 28 with the number of pulses from the transmitter 19 in the error gate 32 will result in the error gate 32 supplying a switch signal to the error flip-flop 33 which will be switched to said other position from the normal position. Then, the alarm device 37 will be activated via the monostable circuit 34 and the amplifier 36 such that the machine attendants will be notified of the fact that a strand break has arisen or that a strand is missing for another reason, e.g. due to the fact that a spool 14 is empty. The alarm device will sound for a predetermined period defined by the monostable circuit 34. However, at the same time the error flip-flop 33 breaks the current supply to the relay 38 from the amplifier 35 via the self-holding contact 39 such that the relay 38 will be de-energized, which means that the relay contact 44 will be adjusted to such position that the machine will be stopped, and also that the lamp 43 will be energized by current being supplied to the lamp from the amplifier 42 via the relay contact 40. Then, the lamp 43 will emit a flashing light the frequency of which is determined by the oscillator 41.

The corresponding function will occur if the monostable circuit 26 should not have re-set the pre-selection counter 28 within the predetermined interval corresponding to the period for one revolution of the spool wheel 11, which may be due to a fault in the system, which has no connection to a broken or missing strand. In that case it is the error guide 27 which adjusts the error flip-flop 33 from the normal position thereof to said other position to activate the alarm and signal devices and to switch-off the machine.

The signal device is switched-off, the error flip-flop 33 is re-set, and the machine is restarted by the switch being closed.

The use of the invention is not limited to the machine described for providing a strand reinforcement on a hose. It can be applied in a corresponding manner to machines for reinforcing cables by means of strands. Also in such cases wherein the strands do not come from a rotating spool wheel but are advanced along fixed paths the invention can be applied by the transmitter 19 being arranged to move in an orbit about strands which are circularly distributed, or being oscillated by a reciprocating movement transversely over a number of strands distributed substantially in one and the same plane.

The shield 21 does not necessarily form part of the transmitter or must not be secured to the transmitter to be mounted to the machine as an integrated part of the transmitter. It can also form part of a holder or the like on the machine, in which the transmitter is then inserted or mounted as a separate element. It is also possible to arrange the transmitter proper spaced from the shield, an optical transmission (fiber cable) being arranged between the shield and the transmitter proper.

The invention can be applied not only for monitoring strands but also for monitoring tapes or the like and is particularly well suited to be used when high-feeding velocities are involved.

I claim:

1. Strand break detector for monitoring a number of longitudinally straightened strands extending along a number of predetermined paths to determine if a strand is broken or missing, comprising:

an optical transmitter with lightreceiving means disposed to provide relative movement between said transmitter and said strands with said movement in a direction generally transverse to said longitudinally straightened strands and said transmitter generating a signal for each strand passing said transmitter in a direction generally transverse to a longitudinal dimension of said strand;

an electronic circuit for receiving and processing the signal from the transmitter;

a shield arranged in front of the light-receiving means and forming an inlet for light to the light-receiving means; and a slide surface on said shield disposed to engage in sliding contact strands approaching said inlet and guiding the strands engaging the slide surface past the light inlet as said transmitter and strands move relative to one another in a direction generally transverse to said longitudinally straightened strands with said slide surface disposed a distance from said light-receiving means to guide said strands past said inlet with strands separated from said light-receiving means by a preselected space.

2. Strand break detector as claimed in claim 1 wherein the shield is opaque, the light inlet being arranged as an aperture in the shield.

3. Strand break detector as claimed in claim 2 wherein the aperture is elongated transversely of the direction of relative movement between the strands and the transmitter transversely of the strands.

4. Strand break detector as claimed in claim 1 wherein the light-receiving means and the shield define a space with inlet and outlet for circulating air through the space.

5. Strand break detector as claimed in claim 4 wherein the aperture arranged as light inlet in the shield forms said outlet.

6. Strand break detector as claimed in claim 1 wherein the shield is made of a transparent material.

7. Strand break detector as claimed in claim 1 wherein the slide surface comprises a curved portion.

8. Strand break detector as claimed in claim 7 wherein the aperture is located centrally of a depression in the curved portion.

* * * * *